United States Patent [19]

Lippert et al.

[11] Patent Number: 5,046,297

[45] Date of Patent: Sep. 10, 1991

[54] WRAPPING MACHINE FOR PAPER NAPKINS

[75] Inventors: Wolfgang Lippert; Franz Hadzelek, both of Bremen, Fed. Rep. of Germany

[73] Assignee: Christian Senning Verpackungautomaten GmbH & Co., Bremen, Fed. Rep. of Germany

[21] Appl. No.: 580,833

[22] Filed: Sep. 11, 1990

[30] Foreign Application Priority Data

Sep. 14, 1989 [DE] Fed. Rep. of Germany ..... 3930786

[51] Int. Cl.[5] ..... B65B 11/08

[52] U.S. Cl. ..... 53/228; 53/529

[58] Field of Search ..... 53/528, 529, 228, 540; 493/478

[56] References Cited

U.S. PATENT DOCUMENTS

| | | | |
|---|---|---|---|
| 3,766,708 | 10/1973 | Kubo | 53/529 X |
| 4,748,794 | 6/1988 | Marchetti | 493/478 X |
| 4,870,807 | 10/1989 | Palamides | 53/529 X |

FOREIGN PATENT DOCUMENTS 0290778 11/1988 European Pat. Off. .

*Primary Examiner*—John Sipos

*Attorney, Agent, or Firm*—Merchant, Gould, Smith, Edell, Welter & Schmidt

[57] ABSTRACT

The receiving station of a packaging machine for stacks of folded paper napkins or the like has a cassette with a base plate and a cover plate. The spacing between the base and cover plates changes automatically not only during the course of each operating cycle, rather the basic spacing between the cover and base plates also capable of being adjusted while the machine is operating, in order to be able to quickly and reliably adapt the width of the cassette to different stack thicknesses.

14 Claims, 2 Drawing Sheets

WRAPPING MACHINE FOR PAPER NAPKINS

TECHNICAL FIELD

The invention relates to a contrivance for packaging a multilayered stack of articles made of paper or the like.

BACKGROUND

In particular a stack of folded paper napkins made of elastic fleece material (tissue), with a station for receiving the pressed stack, said station displaying a cover plate disposed parallel to a base plate, at a defined spacing from the latter by means of lateral supports, said cover plate, however, being movable relative to the base plate between a slide-in position and a closing position in a way such that the spacing changes cyclically by a fixed measure during operation.

This embodiment of a machine for enwrapping packaging of relatively elastic stacks of soft paper napkins has been successfully used in practice. From a compressing station, the stack is transferred into the "cassette" of a receiving station, said "cassette" being formed by the base and cover plates, by means of a pusher engaging the stack on one of its narrow sides. In such a transfer, the packaging foil, which is being kept ready, is carried along by the stack into the receiving station. After the receiving operation has been completed, the packaging foil is sealed on the still-open trailing (viewed in the slide-in direction) narrow side of the stack, to form a strip endlessly enclosing the stack (the package is sealed later along the two still-open lateral, narrow sides of the stack).

In order to facilitate the transfer of the stack and the packaging foil into the cassette, it is known also how to slightly increase the spacing between the base and the cover plate during the transfer operation. This spacing is subsequently reduced to the preset defined or nominal spacing once the stack has reached its correct final position in the cassette, so that the packaging foil can finally be sealed in the correct manner.

The size of said "defined spacing", thus the initial or nominal spacing between the base and the cover plate, is of great importance to the reliable and trouble-free operating function of the packaging machine, particularly if the latter is operated at a high rate, i.e. for example when 100 or more stacks are to be processed per minute.

Similar considerations apply to the change in spacing which, in the manner described above, is changed in the course of each operating cycle during at least part of the feeding of the stack into the receiving station. However, while the cyclic change in spacing may always be the same, which means such change can be fixed by relatively simple constructional means, the "defined spacing" between the base and the cover plates generally has to be varied whenever the material of the articles to be packaged changes, that is even with no change in the size and number of paper napkins or the like in the stack, to the extent that even another dye for the material may lead to a change in the height of the stack, to which the nominal spacing (plus the cyclic change in spacing superimposing such nominal spacing at least temporarily) reacts with great sensitivity in the course of transfer. Therefore, in order to avoid too much waste or rejects, said defined spacing has to be carefully readjusted practically with each change of the material of the goods to be packaged, for example with each exchange of the roll of tissue strip.

Heretofore, for such exchange, the packaging machine is stopped, the fastening of the cover plate (cassette) on its individual supports is released and then tightened again after the nominal spacing has been changed as required. This means that the packaging operation, and thus the entire production process, is interrupted for the duration of such an exchange for at least a few minutes, and thereafter has to be restarted again. In addition, the machine operator has to be very skilled, so that any such change in the nominal spacing will, during the subsequent operation, lead to a correct and reliable operation of the receiving station; if not, another readjustment is required.

The object of the invention is to remedy such drawbacks. According to the invention, provision is made so that the defined spacing between the cover and the base plates is variable while the pack-aging contrivance is in operation. In this manner, the receiving station can be adapted almost instantly to any change in the goods being packaged while retaining the measure of the cyclic change in spacing, without temporary shutdown of the machine and hence without noticeable loss in packaging output. Furthermore, during such adaptation, the effect of the latter on the packaging operation can be directly monitored, so that the correct (new) nominal spacing can be found and started all at once.

In the manufacture of packs of folded paper napkins, for example, it is customary in the case of a roll change to insert a roll with a starting material different from the one processed before. There-fore, as a rule, in such an exchange of rolls, the last stack com-prised of the material of the processed roll is directly followed by a stack consisting of the material of the new roll. Also, the stacks comprised of the new material regularly have a different thickness, which means said stacks require a different nominal spacing in the cassette of the receiving station than the stacks packaged previously. Following such an exchange or rolls, the oper-ator of the machine can now react to such exchange solely by adjust-ing the "defined spacing" between the base and cover plates without being required to do anything else. In such an adjustment, there may be a few packs that might have to be rejected as being improperly packaged, depending upon the case or circumstances; how-ever, such loss comes to only a fraction of the loss associated with the aforedescribed procedures based on the prior art. Preferably, the effective length of the cover plate supports is adjustable. Such an adjustment can be made manually, for example with the aid of a crank drive acting on the two supports. However, according to a special embodiment of the invention, provision is made for a tilting bar to be associated with each support; that the supports be connected by a crossbar; and that the bearing of the tilting levers be adjustable with the aid of a cone-and-spindle drive driven by an electric motor. Such an embodiment permits, in a particularly simple manner, superimposition of the cyclic change in spacing between the base and cover plates on the one hand, and changing of the nominal spacing (with any change in the thickness of the stack of goods to be packaged) on the other hand. According to another feature of the invention, provision is made so that the supports are mounted on the one arm of at least one tilting lever, and such that a cam control engages the other arm of said lever. Said cam control assures an always-constant cyclic change in the plate spacing of the receiving cassette in the machine cycle, such change being dependent upon the control cam, whereas the basic or nominal spacing is adjustable by adjusting the bearings of the tilting levers parallel with the longitudinal direction of the supports. If, in a manner known per se, the receiving station is constructed in a displaceable fashion in the slide-in direction in order, on the one hand, to enable insertion of the packaging foil and, on the other hand, to enable driving the receiving cassette close to the compressing station, then further provided is that the supports be supported with the aid of a rotatable block in a rocker arm embodied in the one arm of the tilting lever.

BRIEF DESCRIPTION OF THE DRAWINGS

The invention is explained in greater detail by reference to an example of embodiment shown in the drawing, in which.

DETAILED DESCRIPTION

Figure 1:
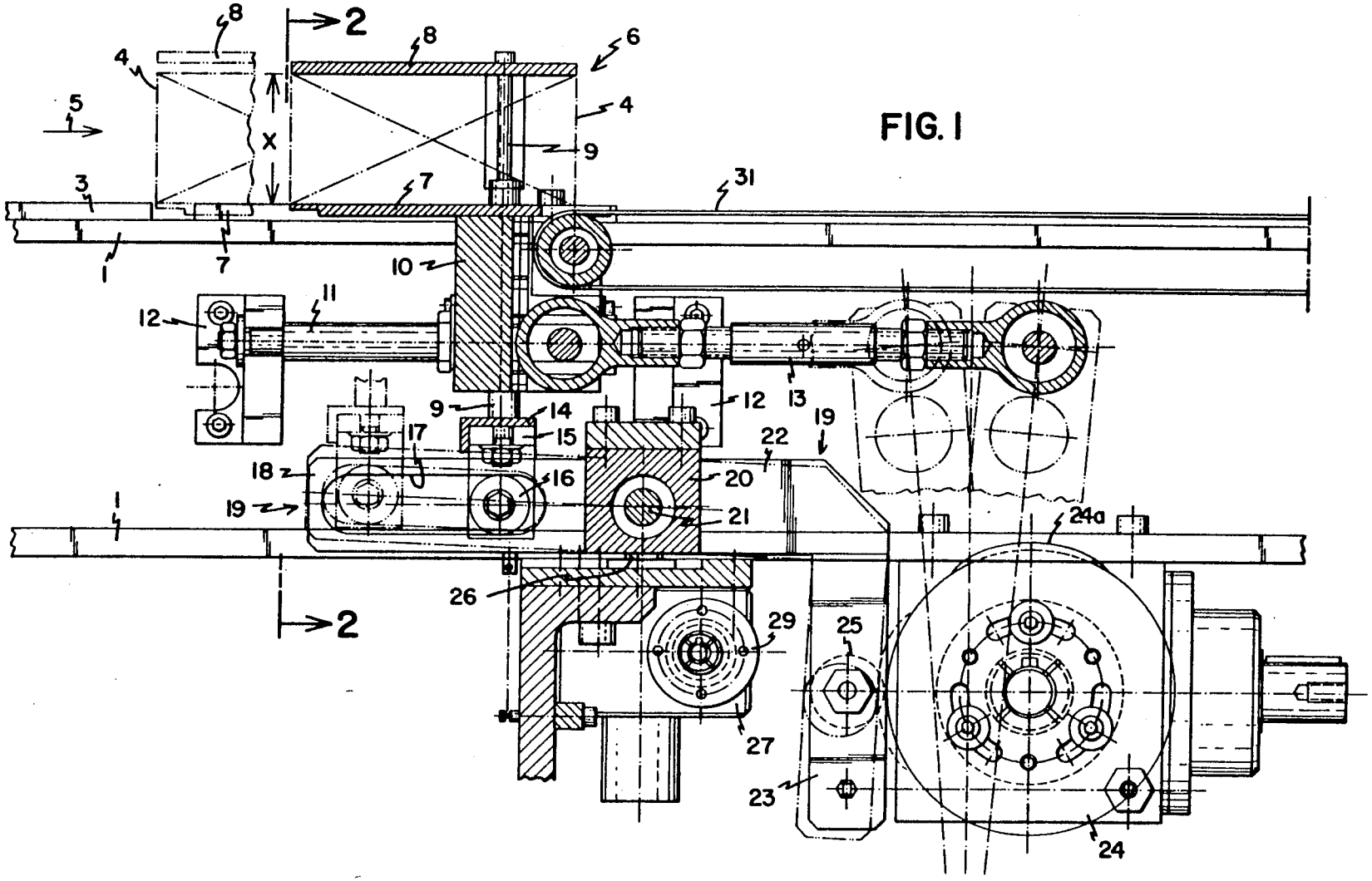
FIG. 1 shows the receiving station (as part of the packaging machine) partially in a vertical cut, partially in a side view.
Figure 2:
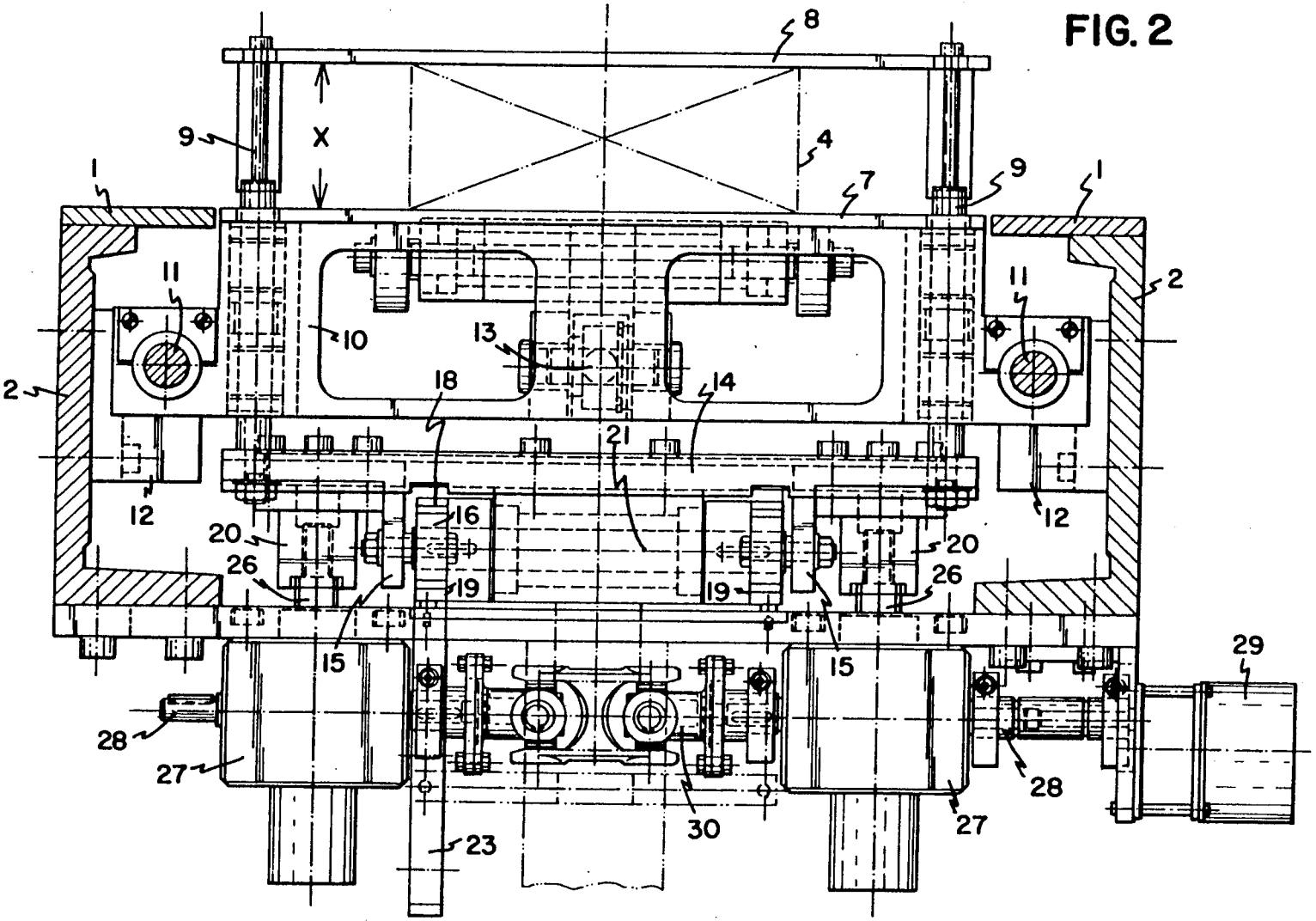
FIG. 2 shows a cut essentially along line II—II in FIG. 1.

FIG. 1 shows plate-like parts 1 of a machine frame, said parts being joined with one another by end pieces 2 (FIG. 2). In FIG. 1, top left, the table plate 3 of the compressing station, not shown in detail in the drawing, is indicated on the top frame part 1. From said compressing station, a stack 4—indicated by dash-dot lines—of paper napkins has been transferred in the direction of arrow 5 into the cassette of the receiving station, said cassette being denoted overall by reference numeral 6. The cassette 6 is comprised of a base plate 7 and a cover plate 8, which is held by supports 9 with a spacing x (in the fully-repre-sented starting position) from the base plate. On the sides, said supports 9 are spaced from the pushed-in stack 4 to an extent such that the lateral projections of the packaging foil find sufficient space (cf. FIG. 2). The supports are supported with lengthwise displaceability in a frame 10 extending crosswise, said frame further supporting the base plate 7, itself being displaceable crosswise by means of the longitudinal ball guides 11, which are supported on the machine frame by the blocks 12. The push rod 13 is linked to the frame 10. When the machine is operating, said push rod drives the entire receiving station from the basic position—totally represented in FIG. 1—into a position advanced to the left and against the table plate 3 of the compressing station, this being indicated by dash-dot lines representing the front edge sections of the base plate 7 and the cover plate 8.

Beneath the frame 8, the supports 9 are connected with one another by a crossbar 14. This latter supports itself in the rocker arms or links 17 by means of the angles 15 and the rollers 16, the latter forming sliding blocks rotatably supported on said angles, whereby said rocker arms or links 17 are embodied in the one arms 18 of the of the tilting levers 19. The tilting levers 19 are supported in swivel-mounted fashion in the bearing blocks 20 and swivel about the axis of tilt 21.

The rocker arms 17 in the arms 18 of the tilting levers 19 permit the rollers 16, which are supported on the crossbar 14, to follow the crosswise displacement of the frame 10 with the supports 9 and to reach the left-hand final position indicated by dash-dot lines in FIG. 1

The other arm 22 of the tilting lever 19 has an angled extension 23 engaged by a cam plate 24, via a scanning roller 25. With its zone 24*a*, said cam plate swivels the tilting lever arm 19 by the measure shown by the dash-dot line, if and so long as the cam plate 24 is rotating. This is the case when the machine is operating and when the cassette 6 of the receiving station has simultaneously been driven into its left-hand position near the compressing station, indicated by the dash-dot line, because in said position a stack of goods to be packaged is pushed into the cassette, so that in the course of the operating cycle the cover plate 8 of said cassette is to be lifted by a slight amount as indicated in FIG. 1, top left.

Such lift is accomplished by the aforementioned tilting movement of the tilting lever 19, by means of which the crossbars 14 and, therewith, the supports 9 are displaced upwardly via the rocker arms or links 17 and the rollers 16. When the frame 10 with the cassette 6 returns to its basic right-hand position (shown in the drawing), the cam section 24*a* of the cam plate 24 also departs from the scanning roller 25 and, consequently, permits the tilting lever 19 to swing back and the cover plate 8 of the cassette 6 to be lowered into its bottom basic position.

Regardless of the above, the relative position of the bearing blocksof the two tilting levers 19 (of which only one has to be cam-controlled) is variable in its vertical (in FIG. 1) position relative to the machine frame and, therefore, relative to the actual receiving station with the frame 10 and the cassette 6. The position of the tilting levers 19 changes with any such change, which in turn results (via the rollers 16 and the crossbar 14) in a corresponding displacement of the supports 9 and, as an end result, in a change of the position of the cover plate 8 relative to the base plate 7. Hence, such vertical displacement of the bearing blocks 20 with the axes of tilt 21 of the tilting levers 19 permits an adjustment of the nominal spacing x between the cover plate 8 and the base plate 7 of the cassette 6 (without any other change in the operating function of the receiving station and in its aforementioned control).

For the purpose of displacement, the bearing blocks 20 are supported on the spindles 26, the latter being driven shafts of the bevel-gear-and-spindle drives 27 whose driving spindles 28 are driven by an electric servomotor 29. The two gearings are coupled by a drive shaft 30. This entire servo-drive for the bearing blocks 20 is in turn attached to part 2 of the basic frame.

For the sake of completeness, let be mentioned that the conveyor belt 31 represented at the the top right in FIG. 1 discharges the stacks of packaged articles—FIG. 1 to the right—with a packaging foil sealed all around. In each case, a packaged stack is pushed from the cassette 6 onto the conveyor belt 31 by the next-following stack.

We claim:

1. A device for packaging a multilayered stack of compressible material, the device comprising a receiving station into which the stack is inserted for packaging, said station comprising:

a base plate;

one or more lateral supports;

a cover plate connected to said lateral supports and arranged by means of said lateral supports parallel with said base plate;

means for displacing said base plate and cover plate in a direction parallel to the plane of the base plate;

first spacing adjusting means connected to said lateral supports for moving said cover plate in a direction orthogonal to the plane of said base plate between a starting position and a final position, said first spacing adjusting means comprises means to change the spacing between the base plate and the cover plate cyclically by a fixed measure during the displacement of said base and cover plates; and second spacing adjusting means connected to said lateral supports for modifying the starting position relative to the base plate during the displacement of said base and cover plates.

2. The device according to claim 1 wherein the second spacing adjusting means comprises a crank drive connected to said lateral supports for adjusting the nominal spacing between the cover plate and the base plate.

3. The device according to claim 1 wherein the said means for changing the spacing comprises a cam control and a tilting lever supported by a bearing block, wherein said tilting lever swivels on said bearing block and wherein a first arm of said tilting lever is connected to said lateral supports and a second arm of said tilting lever is engaged by said cam control to cyclically move said lateral supports and, therefore, said cover plate in a direction orthogonal to the plane of said base plate.

4. The device according to claim 3 wherein the second spacing adjusting means comprises a crank drive connected to said bearing block for moving said bearing block in a direction orthogonal to the plane of said base plate.

5. The device according to claim 3 wherein the second spacing adjusting means comprises a spindle connected to said bearing block for moving said bearing block in a direction orthogonal to the plane of said base plate.

6. The device according to claim 5 wherein said spindle is a driven shaft of a bevel-gear-and-spindle drive, wherein the driving spindles of said bevel-gear-and-spindle drive are driven by an electric servomotor.

7. The device according to claim 6 wherein said electric servomotor is connected to said base plate.

8. The device according to claim 6 wherein said said means for changing the spacing further comprises a rotatable block in a rocker arm embodied in said first tilting lever arm and connected to said lateral supports for control of the movement of said lateral supports orthogonally to the plane of the base plate during displacement of said receiving station.

9. The device according to claim 3 wherein said receiving station comprises a plurality of lateral supports and a crossbar connecting said lateral supports and said first spacing adjusting means further comprises a tilting lever and bearing block associated with each lateral support.

10. The device according to claim 9 wherein the second spacing adjusting means comprises a crank drive connected to said croosbar for moving said bearing blocks in a direction orthogonal to the plane of said base plate.

11. The device according to claim 9 wherein the second spacing adjusting means comprises one or more spindles connected to said crossbar for moving said bearing blocks in a direction orthogonal to the plane of said base plate.

12. The device according to claim 11 wherein said spindles are driven shafts of a bevel-gear-and-spindle drive, wherein the driving spindles of said bevel-gear-and-spindle drive are driven by an electric servomotor.

13. The device according to claim 11 wherein a spindle is connected to the crossbar between each support and its associated tilting lever.

14. The device according to claim 11 wherein said said means for changing the spacing further comprises a rotatable block in a rocker arm embodied in said first tilting lever arm and connected to said lateral supports for control of the movement of said lateral supports orthogonally to the plane of the base plate during displacement of said receiving station.

* * * * *